US006386003B1

(12) United States Patent
Wang

(10) Patent No.: US 6,386,003 B1
(45) Date of Patent: May 14, 2002

(54) YARN FEEDER FOR CIRCULAR KNITTING MACHINE

(75) Inventor: Ping-Shih Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 09/934,472

(22) Filed: Aug. 23, 2001

(51) Int. Cl.[7] ..... D04B 9/34
(52) U.S. Cl. ..... 66/136; 66/141
(58) Field of Search ..... 66/136, 141, 111, 66/125 R, 132 R, 132, 146, 137; 242/157 R; 112/302, 254

(56) References Cited

U.S. PATENT DOCUMENTS 2,796,752 A * 6/1957 Hauberg ..... 66/136
3,677,036 A * 7/1972 Hatay ..... 66/136
3,757,537 A * 9/1973 York ..... 66/136
3,800,564 A * 4/1974 Carswell ..... 66/136
4,426,855 A * 1/1984 Wells et al. ..... 66/136
4,688,401 A * 8/1987 Kuhn et al. ..... 66/136
5,127,241 A * 7/1992 Plath ..... 66/136
5,513,503 A * 5/1996 Gray et al. ..... 66/136
5,738,296 A * 4/1998 Wu ..... 66/136
6,101,849 A * 8/2000 Pernick ..... 66/136
6,182,475 B1 * 2/2001 Lee ..... 66/136

* cited by examiner

*Primary Examiner*—Danny Worrell
(74) *Attorney, Agent, or Firm*—Bacon & Thomas

(57) ABSTRACT

A yarn feeder for circular knitting machines includes a jutting section located on a yarn feeding section of the yarn feeder. The jutting section has a yarn directing surface to allow the yarn to either slide over the surface without forming floss, or to retain the floss on the jutting section. Thereby, the yarn maybe fed smoothly and effectively above the knitting needle without rupturing to allow the knitting needle to raise and pick up the yarn as the knitting operation proceeds.

10 Claims, 5 Drawing Sheets

YARN FEEDER FOR CIRCULAR KNITTING MACHINE

FIELD OF THE INVENTION

The present invention relates to an improved yarn feeder for circular knitting machine and particularly a yarn feeder that has a jutting strut to facilitate delivering a yarn to a knitting needle for knitting fabrics.

BACKGROUND OF THE INVENTION

A lot of clothing people wearing these days is made from knitting fabrics produced by circular knitting machines. When a circular knitting machine proceeds knitting operations, there are yarn feeders feed yarns continuously to knitting needles. The knitting needles stitch or tuck the yarns to loops for forming the fabrics desired. When knitting knitted or stretch fabrics, an additional stretch yarn will be provided to go through the yarn feeder to blend with other yarns to produce the stretch or knitted fabrics (such as for making underwear). However conventional yarn feeders have a lot of problems when feeding the stretch yarn.

FIG. 1 shows a conventional yarn feeder 1 which includes a body 11 and a yarn feeding section 12 extending from a lower end of the body 11. The yarn feeding section 12 has at least one aperture 13, 13' for yarns to pass through. The body 11 further has a slot 16 engaging with an adjusting element 2 for supporting a yarn roller 3. The yarn roller 3 guides the stretch yarn above the knitting needle to facilitate the knitting needle to pickup the yarn. However the yarn passing the roller tends to tremble and may cause the knitting needle missing or not completely picking the yarn. The resulting fabrics could have rough surface or voids, and have lower fabric quality.

To remedy the problems, some producers design the yarn feeding section 12 with a guide slot 17 as shown in FIG. 2. The yarn leaving the roller 3 is directed to the guide slot 17 which may eliminate yarn trembling. But the yarn tends to incur floss when sliding and scraping in the guide slot 17 for a long period of time. The floss will accumulate in the guide slot 17 and could eventually block the slot and make yarn difficult to pass through the slot, and could result in yarn broken, or the floss will be carried along the yarn and knitted in the fabric and form snarls on the fabric surface. This also will result in poor fabric quality.

SUMMARY OF THE INVENTION

The primary object of the invention is to resolve the foregoing disadvantages. The invention aims to provide an improved yarn feeder which has a jutting section located at one end of the yarn feeder. The jutting section has a yarn directing surface to allow the third yarn sliding over in a friction contact without producing floss or having the floss retained on the jutting section so that the yarn may be fed smoothly to the knitting needle without rupturing and knitting operation can be proceeded smoothly.

Another object of the invention is to provide to replace the jutting section with a strut which may be integrally formed with the yarn feeding section. The strut has a curvy yarn directing surface to allow the third yarn sliding over in a friction contact without producing floss or having the floss retained on the strut so that the yarn may be fed smoothly without rupturing.

A further object of the invention is to provide a fastening section at one end of the strut while the yarn feeding section has a fastening aperture formed at one end thereof. The fastening aperture has a fastening surface to engage with the fastening section. Or the fastening section may run through the fastening aperture and fastened by a screw nut for anchoring the strut on the yarn feeding section. The strut has the curvy yarn directing surface to allow the third yarn sliding over in a friction contact without producing floss or having the floss retained on the strut so that the yarn may be fed smoothly without rupturing.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 2:
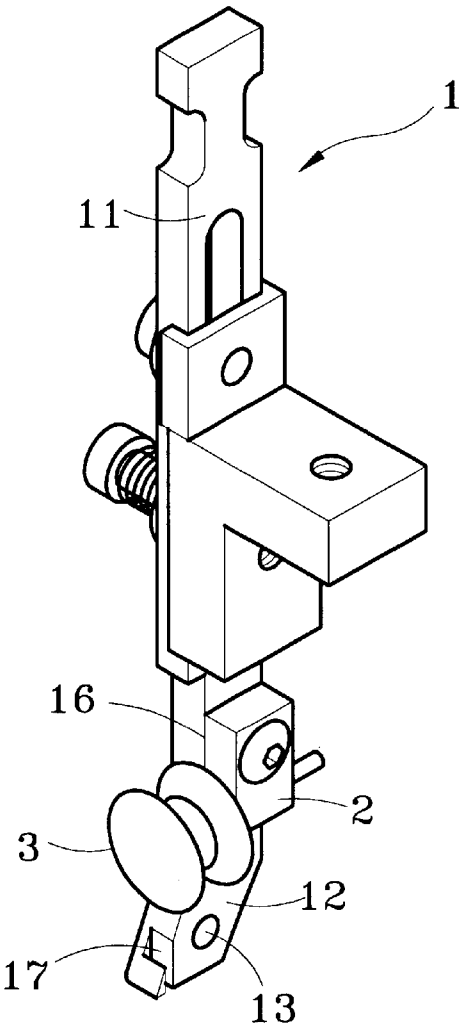
Fig.2 PRIOR ART
FIG. 2 is a perspective view of another conventional yarn feeder.
Figure 1:
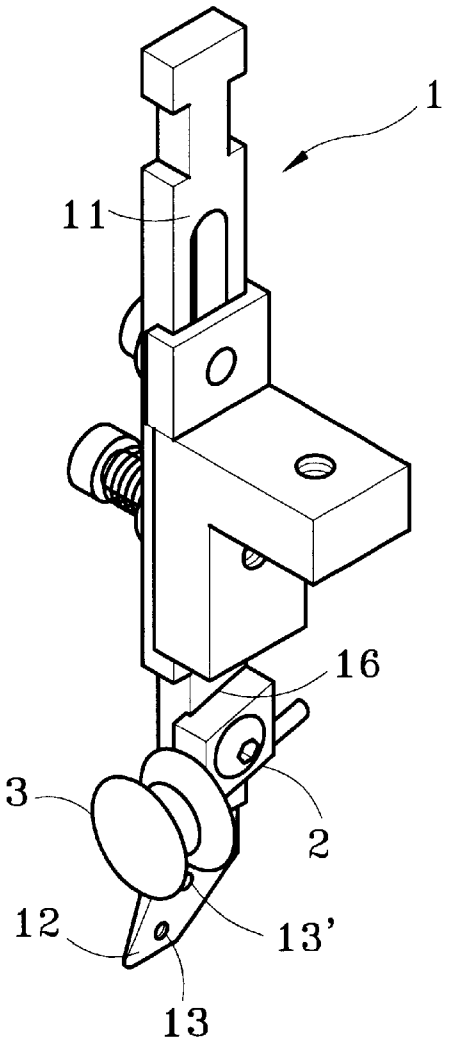
Fig.1 PRIOR ART
FIG. 1 is a perspective view of a conventional yarn feeder.
Figure 3B:
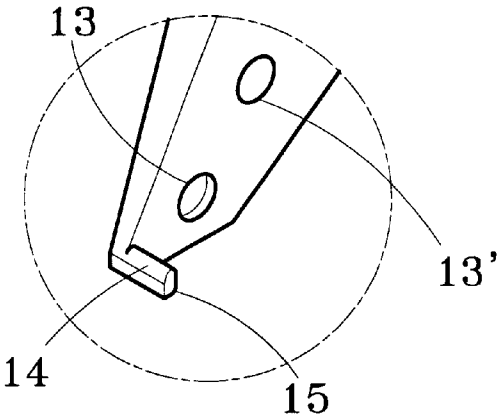
FIG. 3B is a fragmentary enlarged view of FIG. 3A.
Figure 3A:
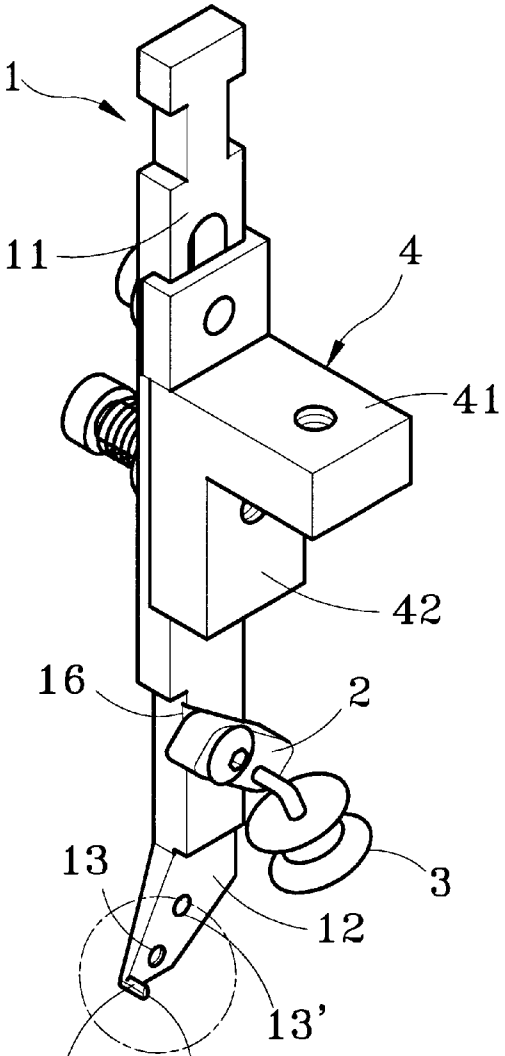
FIG. 3A is a perspective view of a yarn feeder of the invention.

Referring to FIGS. 3A and 3B, the yarn feeder 1 of the invention is mounted to a circular knitting machine above knitting needles (not shown in the drawings) for holding a plurality of yarns to be picked up by the rising knitting needles.

The yarn feeder 1 includes at least a body 11 and a yarn feeding section 12 extending from a lower end of the body 11. The yarn feeding section 12 has at least one aperture 13, 13' for a yarn to pass through. Another end of the yarn feeding section 12 has a jutting section 14 which has a curvy yarn directing surface 15 to facilitate the yarn passing. The body 11 further has a slot 16 formed at a selected location to engage with an adjustment element 2. There is a yarn roller 3 mounting on the adjustment element 2 for directing a knitting yarn below the jutting section 14 to feed the yarn for the circular knitting machine to use in the knitting operations.

There is an anchor member 4, which has a mounting section 41 for fastening to the circular knitting machine. The mounting section 41 has one end extended to form a support section 42 which has a sliding slot (not shown in the drawing) formed thereon. The body 11 of the yarn feeder 1 is pivotally mounted to the sliding slot of the support section 42. Hence the elevation of the yarn feeder 1 may be changed and adjusted on the anchor member 4.

Figure 4:
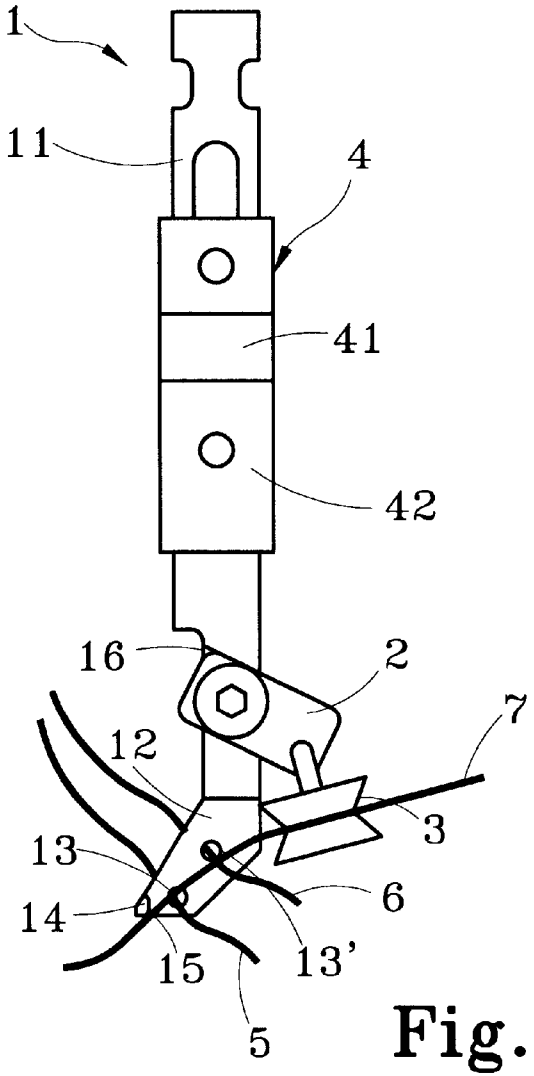
FIG. 4 is a front view of the yarn feeder according to FIG. 3A.
Figure 5:
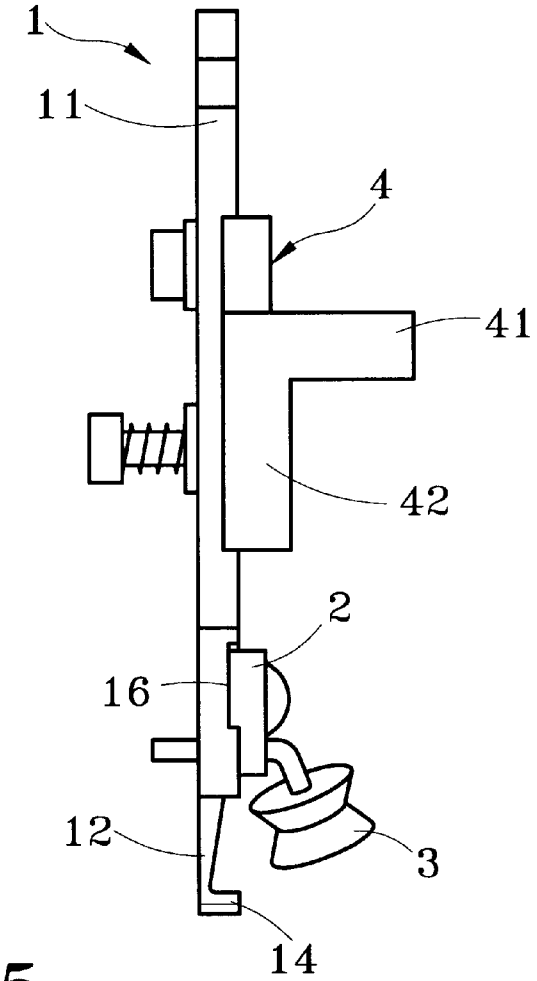
FIG. 5 is a side view of the yarn feeder according to FIG. 3A.

Referring to FIGS. 4 and 5, when in use, the yarn feeder 1 is mounted to the circular knitting machine through the anchor member 4. The first yarn 5 and the second yarn 6 are threaded respectively through the apertures 13 and 13'. The stretch third yarn 7 runs over the yarn roller 3, sliding over the yarn directing surface 15 of the jutting section 14.

During knitting operations, the first, the second and the third yarn 5, 6, 7 are moved respectively above the knitting needles. Then the knitting needles may be raised upwards to pick up the first yarn, the second yarn and the third yarn 5, 6, 7 for knitting the fabric. When the third yarn 7 slides over the yarn directing surface 15 of the jutting section 14, the third yarn 7 maintains a friction contact with the yarn directing surface 15. The third yarn 7 thus will be prevented from forming floss, or the floss will be retained on the jutting section 14. Hence rupturing of the third yarn 7 during feeding process can be prevented or minimized. The third yarn 7 thus may be delivered effectively above the knitting needle to facilitate smooth knitting operation and achieve better quality of the knitting fabric.

Figure 6:
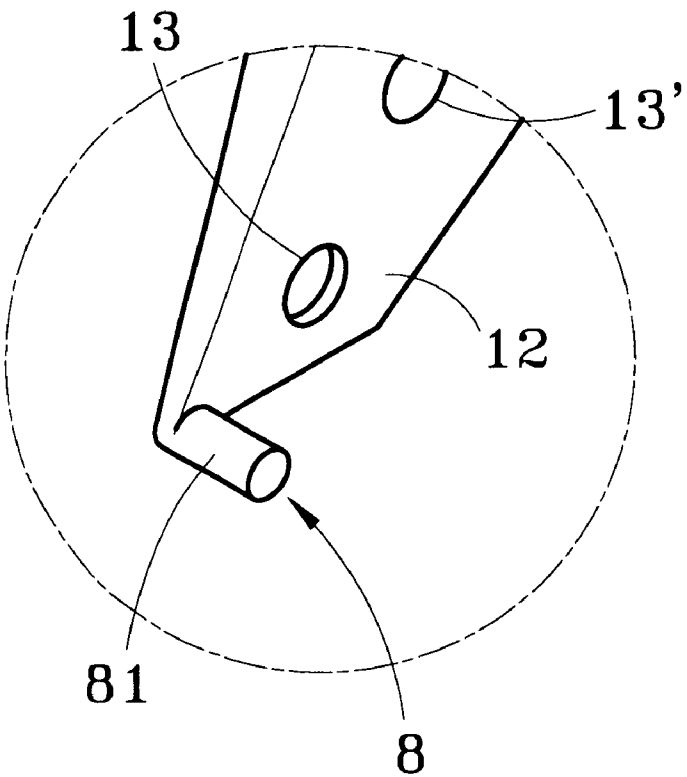
FIG. 6 is a fragmentary schematic view of another embodiment of the invention.

Referring to FIG. 6 for another embodiment of the invention, the jutting section 14 may be substituted by a strut 8, which may be integrally formed with the yarn feeding section 12. The strut 8 has a curvy yarn directing surface 81. When the third yarn 7 slides over the yarn directing surface 81 of the strut 8, the third yarn 7 maintains a friction contact with the yarn directing surface 81 and prevents the yarn from forming floss, or the floss will be retained on the strut 8. Hence rupturing of the third yarn 7 during feeding process can be prevented or minimized.

Figure 7:
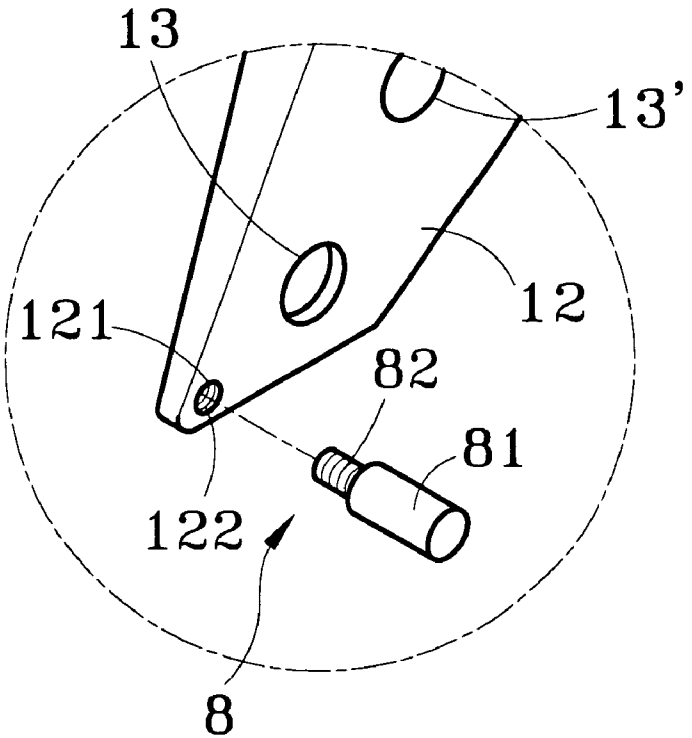
FIG. 7 is a fragmentary schematic view of yet another embodiment of the invention.

Referring to FIG. 7 for yet another embodiment of the invention which is largely constructed like one shown in FIG. 6. The main difference is the construction of the strut 8. In this embodiment, the strut 8 has one end formed a fastening section 82 with screw threads. The yarn feeding section 12 has a fastening aperture 121 formed at one end with a screw thread fastening surface 122 to engage with the fastening section 82. Another alternative is to have the fastening section 82 running through the fastening aperture 121 and engaging with a screw nut (not shown in the drawing) for fastening the strut 8 to the yarn feeding section 12. When the third yarn 7 slides over the yarn directing surface 81 of the strut 8, the third yarn 7 maintains a friction contact with the yarn directing surface 81 and prevents the yarn from forming floss, or the floss will be retained on the strut 8. Hence rupturing of the third yarn 7 during feeding process can be prevented or minimized.

Figure 8:
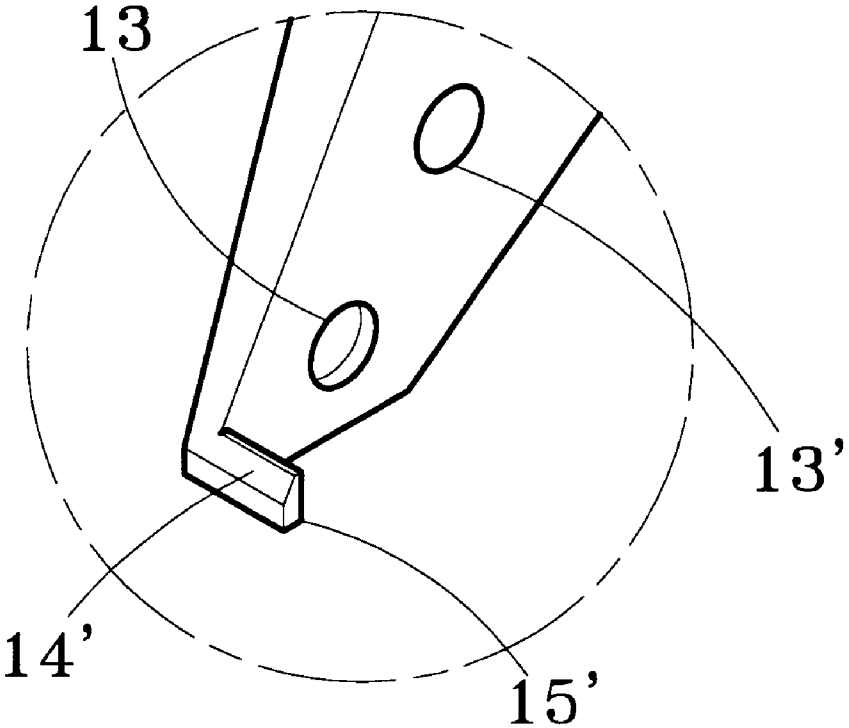
FIG. 8 is a fragmentary schematic view of still another embodiment of the invention.

Referring to FIG. 8 for still another embodiment of the invention, the jutting section 14' located on the yarn feeding section 12 is thinner than the jutting section 14 set forth in the previous embodiments. The jutting section 14' has a normal yarn directing surface 15' formed on one side thereof. The third yarn 7 may form a friction contact with the yarn directing surface 15' and prevent the yarn from forming floss, or the floss may be retained on the jutting section 14'. Hence rupturing of the third yarn 7 during feeding process can be prevented or minimized.

What is claimed is:

1. An improved yarn feeder for a circular knitting machine for supplying a yarn to a knitting needle located below the yarn feeder, comprising at least:

a body mounted to the circular knitting machine; and a yarn feeding section extending from a lower end of the body having at least one aperture for threading at least one first yarn above the knitting needle, guide roller means for guiding an additional yarn above the knitting needle, and a jutting section located at one end of the yarn feeding section, the jutting section having additional yarn directing means including a yarn directing surface for positioning the additional yarn relative to the guide roller so as to allow the additional yarn to slide over the jutting section without forming floss or, if floss is present, for retaining the floss on the jutting section, thereby preventing the yarn from rupturing during feeding to the knitting needle, facilitating a knitting operation by the knitting needle.

2. The improved yarn feeder of claim 1, wherein the yarn directing surface is selectively a curved surface, a slant surface or normal.

3. The improved yarn feeder of claim 1, wherein the jutting section is a strut with a curved yarn directing surface.

4.The improved yarn feeder of claim 3, wherein the strut is integrally formed with the yarn feeding section.

5. An improved yarn feeder for a circular knitting machine for supplying a yarn to a knitting needle located below the yarn feeder, comprising at least:

a body mounted to the circular knitting machine; and a yarn feeding section extending from a lower end of the body having at least one aperture for threading a yarn above the knitting needle, and a jutting section located at one end of the yarn feeding section, the jutting section having a yarn directing surface arranged to either allow the yarn to slide over the jutting section without forming floss or to retain the floss on the jutting section, thereby preventing the yarn from rupturing during feeding to the knitting needle, facilitating a knitting operation by the knitting needle, wherein the jutting section is a strut with a curved yarn directing surface, and wherein the strut has fastening section formed at one end thereof to engage with a fastening aperture formed on the yarn feeding section.

6. The improved yarn feeder of claim 5, wherein the fastening section is a screw.

7. The improved yarn feeder of claim 5, wherein the fastening aperture has a screw fastening surface.

8. The improved yarn feeder of claim 5, wherein the fastening section runs through the fastening aperture to engage with a screw nut.

9. The improved yarn feeder of claim 1, wherein the body has a slot formed at a selected location to engage with an adjustment element, the adjustment element having a yarn roller mounted thereon for directing the yarn to pass under the jutting section.

10. The improved yarn feeder of claim 1 further having an anchor member fastened to the circular knitting machine, the anchor member having a mounting section, the mounting section having one end extended to form a support section which has a sliding slot formed thereon for fastening the body of the yarn and allowing the yarn feeder to move on the anchor member for adjusting the elevation of the yarn feeder.

* * * * *